US008066323B2

(12) United States Patent
McCabe

(10) Patent No.: US 8,066,323 B2
(45) Date of Patent: Nov. 29, 2011

(54) METHOD AND APPARATUS FOR SITTING

(76) Inventor: Timothy Lee McCabe, Albany, NY (US)

( * ) Notice: Subject to any disclaimer, the term of this patent is extended or adjusted under 35 U.S.C. 154(b) by 284 days.

(21) Appl. No.: 12/358,603

(22) Filed: Jan. 23, 2009

(65) Prior Publication Data

US 2010/0187867 A1 Jul. 29, 2010

(51) Int. Cl.
*A47C 4/00* (2006.01)
*A47C 9/10* (2006.01)

(52) U.S. Cl. ..... 297/16.2; 297/16.1; 297/461

(58) Field of Classification Search ..... 297/16.1, 297/16.2, 461
See application file for complete search history.

(56) References Cited

U.S. PATENT DOCUMENTS

| | | | | | |
|---|---|---|---|---|---|
| 0,413,962 | A | | 10/1889 | Putnam | |
| 1,295,265 | A | | 2/1919 | Bradley | |
| 1,371,263 | A | | 3/1921 | Reed | |
| 2,358,059 | A | | 9/1944 | Custer | |
| 2,710,733 | A | | 6/1955 | Phillips | |
| 2,722,973 | A | * | 11/1955 | Murcott | 108/118 |
| 2,749,147 | A | | 6/1956 | Herrschaft | |
| 2,859,080 | A | | 11/1958 | Botnick | |
| 3,242,887 | A | | 3/1966 | Haydock | |
| 4,708,308 | A | | 11/1987 | Snider | |
| 4,934,638 | A | * | 6/1990 | Davis | 248/164 |
| 5,118,136 | A | * | 6/1992 | Johnson | 280/812 |
| 6,135,557 | A | * | 10/2000 | Gustafsson | 297/344.18 |
| 6,634,704 | B1 | * | 10/2003 | Bergquist | 297/16.2 |
| 7,367,617 | B1 | | 5/2008 | Bond et al. | |
| 7,384,097 | B2 | | 6/2008 | Park et al. | |
| 7,401,850 | B2 | | 7/2008 | Micheel | |
| 2004/0066064 | A1 | | 4/2004 | Neely et al. | |

OTHER PUBLICATIONS

Smith Industries, "Natural Tree Furniture" http://www.naturaltreefurniture.com/RusticChairs.html, retreived on Jan. 25, 2011; available Oct. 22, 2006. Retrieved from the internet: URL: http://web.archive.org/web/20061022215201/http://www.naturaltreefurniture.com/RusticChairs.html.*

* cited by examiner

*Primary Examiner* — David Dunn
*Assistant Examiner* — Philip Gabler
(74) *Attorney, Agent, or Firm* — Schmeiser, Olsen & Watts LLP

(57) ABSTRACT

An apparatus for sitting is provided including a semi-flexible fulcrum band having an inner surface, the inner surface integrally including at least one penetration member, wherein the semi-flexible fulcrum band is configured to hold together a plurality of leg members having different varieties, permitting the plurality of leg members to spread above and below the fulcrum band into a supporting position. The apparatus further includes a flexible seat portion containing a plurality of pockets, each pocket configured to receive an upper end of one of the plurality of leg members when the plurality of leg members are in the supporting position, whereby the flexible seat portion is adapted for supporting a person sitting on said flexible seat portion. Finally, the at least one penetration members is configured to penetrate at least one of the plurality of leg members when the person sits in the flexible seat portion.

19 Claims, 6 Drawing Sheets

METHOD AND APPARATUS FOR SITTING

FIELD OF THE INVENTION

The subject matter disclosed herein relates generally to a method and apparatus for sitting. More particularly, the subject matter relates to compact and lightweight outdoor stool components.

BACKGROUND OF THE INVENTION

When camping, hiking, or the like it is desirable to minimize the weight and carrying size of supplies which must often be carried for long distances and across many types of terrain. Stools and chairs have been considered for use in these outdoor activities which utilize lightweight flexible fabric seats and collapsible legs. These features allow the stool or chair to fold into a compact carrying position. These folding chairs, however, remain substantially heavy and cumbersome due to the inherent weight and volume required by the structural supports, such as leg members and back rest members, of the chair. Some foldable chair designs limit this deficiency by using lightweight materials for the structural supports. However, even the lightest of these foldable chairs require structural supports having a considerable weight and bulk as a consequence of the amount of weight that the structural supports must be suitable to support.

Thus, an apparatus and method for sitting that eliminates the weight and bulk of the structural supports required to be carried to the sitting destination would be well received in the art.

BRIEF DESCRIPTION OF THE INVENTION

According to one aspect of the invention, an apparatus for sitting is provided including a fulcrum band having an inner surface, the inner surface integrally including at least one penetration member, wherein the fulcrum band is configured to hold together a plurality of leg members having different varieties, permitting the plurality of leg members to spread above and below the fulcrum band into a supporting position. The apparatus further includes a flexible seat portion containing a plurality of pockets, each pocket configured to receive an upper end of one of the plurality of leg members when the plurality of leg members are in the supporting position. Finally, the at least one penetrations member is configured to penetrate at least one of the plurality of leg members when downward force is applied to the flexible seat portion.

According to another aspect of the invention, a method for sitting comprises providing a plurality of leg members, inserting the plurality of leg members into a fulcrum band, spreading the plurality of leg members above and below the fulcrum band into a supporting position, inserting an upper end of each of the plurality of leg members into a pocket of a flexible seat portion, whereby the flexible seat portion adapted to support a person, and penetrating at least one of the plurality of leg members with at least one penetration member integrally located on an inner surface of the fulcrum band when the person sits in the flexible seat portion.

According to yet another aspect of the invention, an apparatus for sitting comprises a semi-flexible fulcrum band having an inner surface, the inner surface integrally including at least one penetration member, wherein the semi-flexible fulcrum band is configured to hold together a plurality of leg members and permitting the plurality of leg members to spread above and below the fulcrum band into a supporting position, a flexible seat portion containing a pocket configured to receive an upper end of a leg member when the plurality of leg members are in the supporting position, whereby the flexible seat portion is adapted for supporting a seated person, wherein the fulcrum band and the flexible seat portion are configured to permit the use of tree branches of a variety of shapes and sizes as one of the leg members, and wherein the at least one penetration member is configured to penetrate the tree branch when the person sits in the flexible seat portion.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
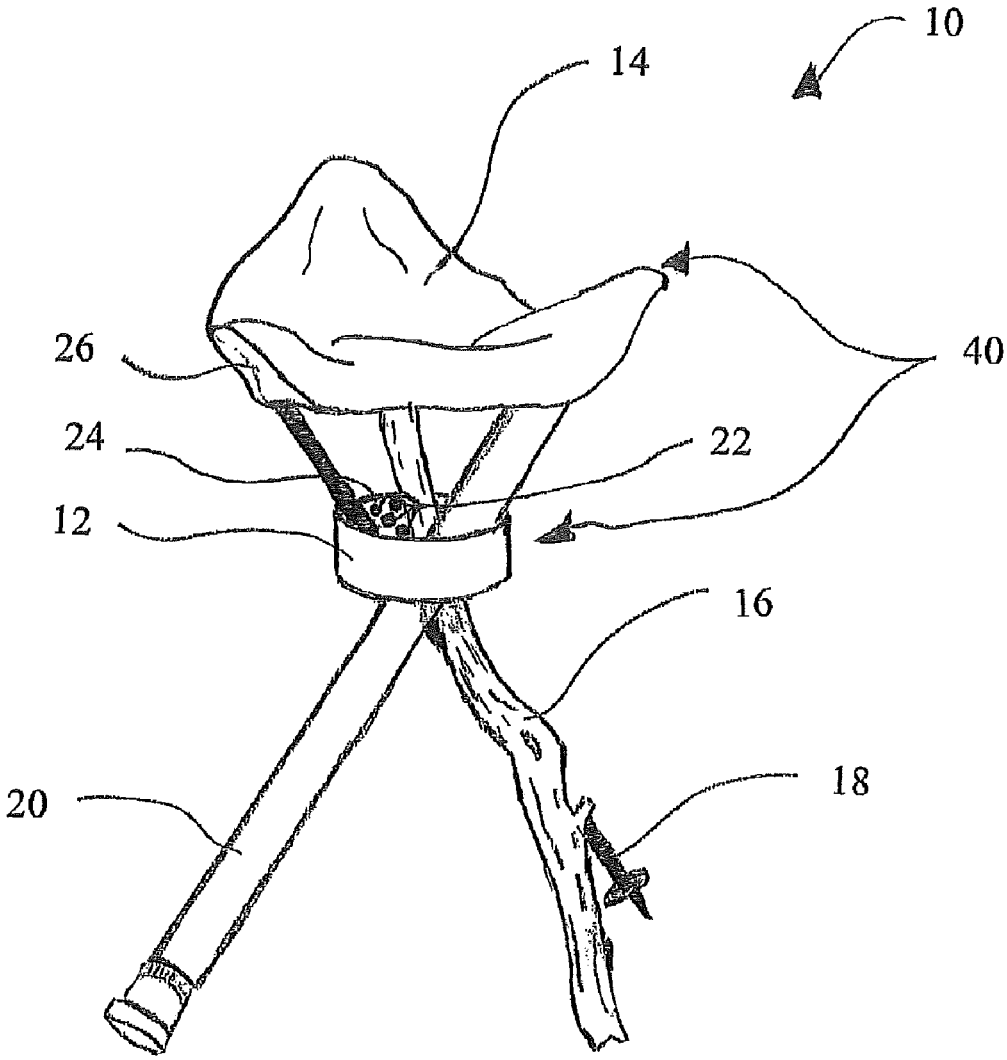
FIG. 1 depicts a perspective view of a stool assembly in accordance to one embodiment of the present invention.

Referring firstly to FIG. 1, there is shown an assembled stool 10 in accordance with one embodiment of the present invention. The assembled stool 10 includes a fulcrum band 12, a flexible seat portion 14, and a plurality of leg members 16, 18, 20. The leg members 16, 18, 20 are fashioned together to form a crisscrossed tri-pod. The fulcrum band 12 acts as a fulcrum point, holding the leg members 16, 18, 20 in close proximity within the fulcrum band 12. The fulcrum band 12 is integrated with a plurality of penetration members 22 on an inner surface 24. The plurality of penetration members 22 are designed to penetrate leg members 16, 18, 20 to prevent the fulcrum band 12 from sliding along the axis of the leg members 16, 18, 20 when a person sits in the seat portion 14. In the embodiment shown, the seat portion 14 comprises a flexible fabric and includes a plurality of pockets 26, each pocket 26 being configured to receive the upper end of one of the leg members 16, 18, 20. The novel features of the fulcrum band 12 in combination with the seat portion 14 provide an apparatus for sitting 40 which allows a camper or hiker to scavenge around for a variety of suitable leg members upon reaching a sitting destination, rather than requiring them to be carried during a hike. As shown in FIG. 1, the apparatus for sitting 40 may use all varieties of rod-like members such as a tree branch 16, a walking cane 18 and a ski pole 20. Examples of other acceptable varieties of leg members include, but are not limited to, tent poles, metal rods, baseball bats, bamboo limbs, lacrosse sticks, golf clubs and hockey sticks.

Figure 2:
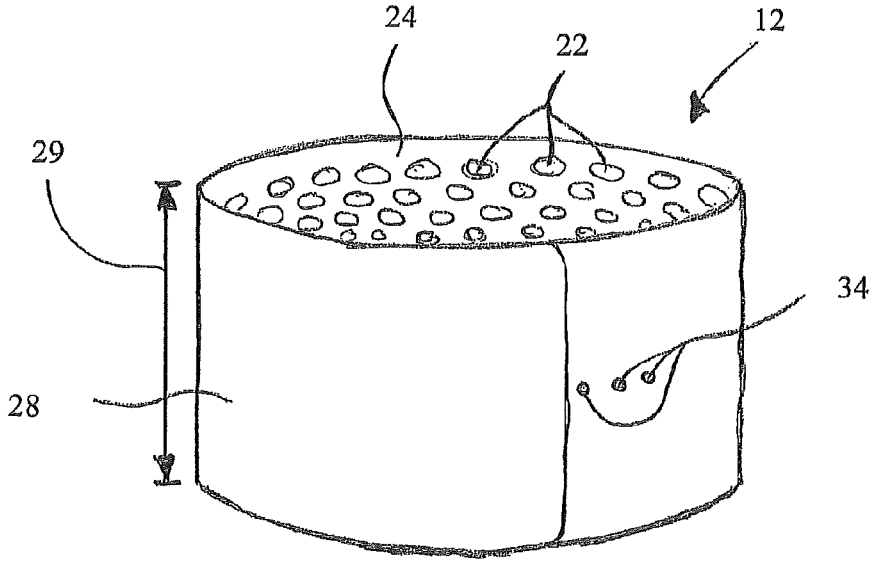
FIG. 2 depicts a perspective view of a fulcrum band attached in ring shape with an attachment mechanism in accordance with one embodiment of the present invention.
Figure 3:
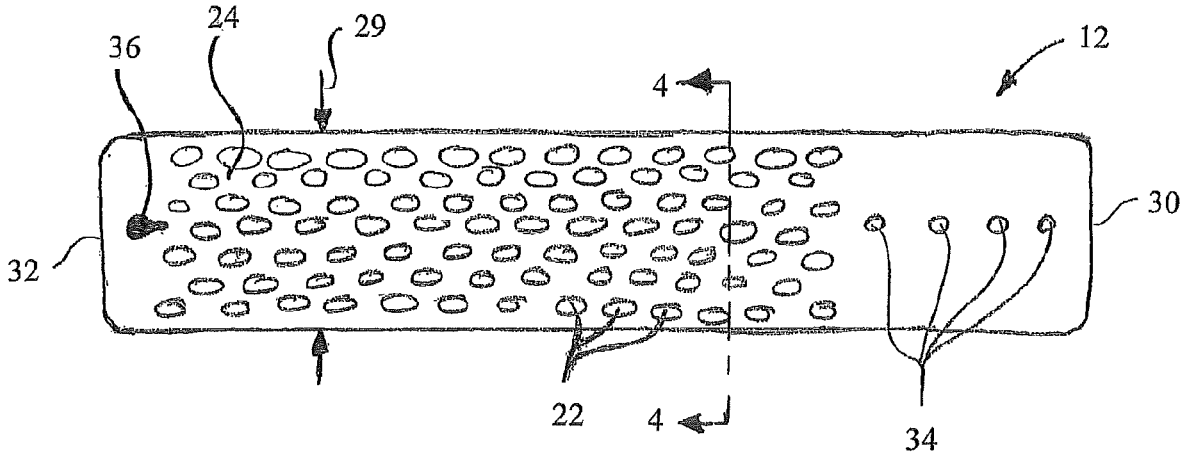
FIG. 3 depicts a top view of an inner surface of the fulcrum band in FIG. 2, prior to attachment into a ring shape in accordance with one embodiment of the present invention.

FIG. 2 depicts a more detailed perspective view of the fulcrum band 12 attached at both ends to form a collar, while FIG. 3 depicts the inside surface of the fulcrum band 12 prior to attachment. The fulcrum band 12 has an inner surface 24, an outer surface 28 and a thickness 29. An appropriate thickness 29 may be used to maximize the contact surface between the inner surface 24 and the leg members 16, 18, 20 during use of the stool 10. The appropriate thickness 29 may be between 1 inch and 6 inches, depending on factors such as the flexibility of the fulcrum band and the size and shape of the intended leg members.

In the embodiment depicted in the figures, the fulcrum band 12 is made of a semi-flexible material. The fulcrum band 12 may be flexible enough to deform when the leg members 16, 18, 20 apply radial pressure on the inner surface 24, thereby increasing the contact area between the inner surface 24 and the leg members 16, 18, 20. However, the fulcrum band 12 may also be rigid enough to hold the leg members 16, 18, 20 together as a fulcrum point. For example, the fulcrum band 12 may be nylon, Kevlar, thick canvass, a wide leather belt strap or any other material having a similar flexibility and toughness. It is even contemplated that the fulcrum band 12 may be roll of duct tape having only a small amount of tape left on the outer surface 28, the small amount of tape providing the flexible cardboard inner surface 24 of the duct tape roll additional strength. As an example, the fulcrum band 12 may have a Young's modulus between 0.005 and 0.2 GPa.

Fulcrum band 12 is shown to also include an attachment mechanism to couple longitudinal ends 30, 32 together, thereby forming the fulcrum band 12 into a band or collar shape. In the embodiment depicted in the figures, the attachment mechanism is a plurality of longitudinally spaced holes 34 extending from a first longitudinal end 30. The longitudinally spaced holes 34 are adapted to receive a pin 36 that is located on the inner surface 24 of the fulcrum band 12 and in close proximity to a second longitudinal end 32. The pin 36 may be curved so that when it is inserted into one of the holes 34 the attachment holds upon the application of radial force to the inner surface 24 of the fulcrum band 12. Additionally, the plurality of longitudinally spaced holes allows the fulcrum band to fit tightly around leg members of a variety of different shapes and sizes. It should be understood that this embodiment only exemplifies the attachment mechanism, but the attachment mechanism is not limited to this embodiment. For example, the attachment mechanism may be a hole and metal clasp arrangement of a traditional belt, buttons, Velcro or any other attachment mechanism that would be apparent to those skilled in the art. Alternately, the fulcrum band 12 may not require any attachment mechanism, but instead may simply be a single unbroken collar shape. For example, the fulcrum band 12 may be a Kevlar ring.

Figure 4:
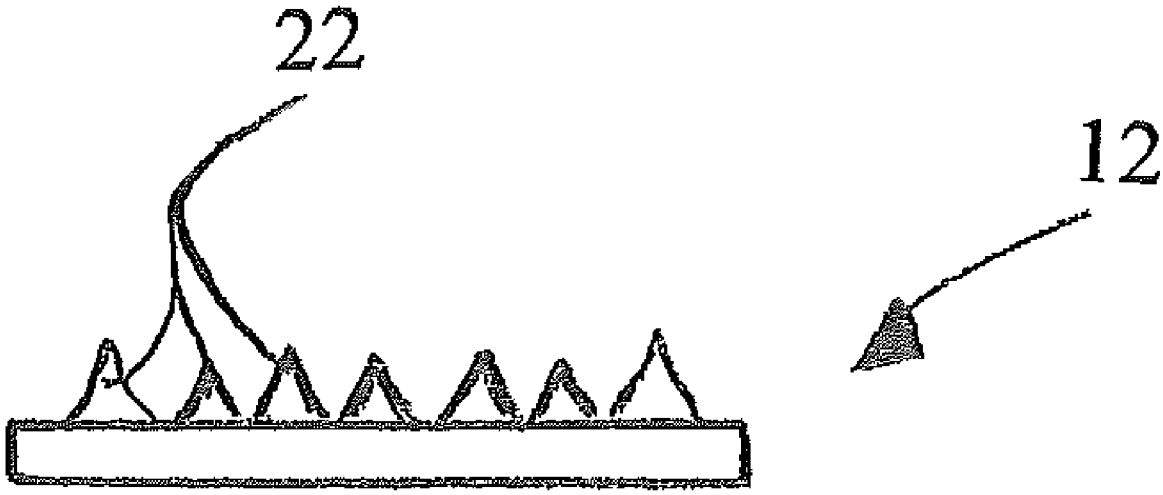
FIG. 4 depicts a cross sectional view of the fulcrum band in FIG. 3, taken at arrows 4-4.

The fulcrum band 12 further includes a plurality of penetration members 22. The penetration members 22 are shown more clearly in FIG. 4. Penetration members 22 are designed to penetrate leg members 16, 18, 20. The grip provided by the penetration members 22 to the leg members 16, 18, 20 also prevents the leg members 16, 18, 20 from sliding radially outward, and the fulcrum band 12 to slide upward, when the stool 10 is employed on a low friction surface such as rock or ice. The penetration members 22 may be a wood file, cheese grader grips, spikes, shark teeth, tacks, nails or the like. In other embodiments, the fulcrum band includes a single penetration member, such as being encircled by chicken wire or sandpaper. The penetration members 22 may be configured to penetrate the surface of a leg member as a downward force is applied to the seat portion, such as when a person sits in the stool 10, forcing the leg members 16, 18, 20 against the penetration members 22. The penetration members 22 may thus be configured to penetrate wooden, or other such surfaces having a Janka hardness between 100 and 4500 in such a fashion. Furthermore, the penetration members 22 are integrally formed and/or located on the inside surface 24 the fulcrum band 12 so that the fulcrum band 12 does not require screws, nails or spikes or other such loose gripping pieces that could be easily lost on an outdoors expedition. Additionally, penetration members 22 may be integrated onto the surface 24 in any pattern or form, as it should be understood that the invention is not limited to the pattern shown in the figures.

Figure 5:
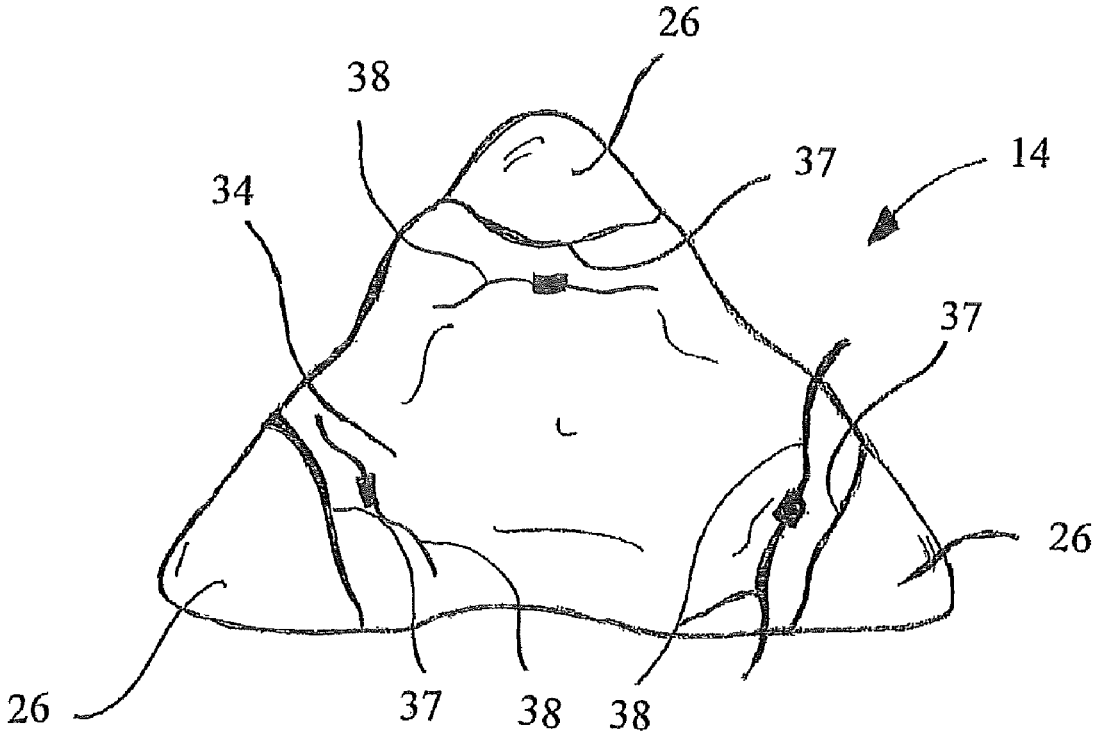
FIG. 5 depicts a top view of the bottom side of a flexible seat portion having pockets in accordance with one embodiment of the present invention.

Turning now to FIG. 5, a bottom side 34 of the flexible seat portion 14 is shown. The flexible seat portion 14 may be made of nylon or any other appropriate fabric or flexible material that is comfortable for a person to sit on. The flexible seat portion may be generally triangular shaped and has three pockets 26, one at each corner. Each pocket 26 is configured to receive a top end of one of the leg members 16, 18, 20 during assembly. Therefore, openings 37 of the pockets 26 and the overall size of the pockets 26 are such that they are capable of receiving leg members 16, 18, 20 having a variety of sizes and shapes. Furthermore, the pockets may be reinforced by an extra layer of fabric or the like in order to prevent the legs from piercing through the fabric.

While the depicted seat portion 14 is configured with three pockets 26 which accept three leg members 16, 28, 20, as shown in FIG. 1, four or more leg member configurations are contemplated. For example, the flexible seat portion 14 may include four corners with pockets in order to accept four leg members. In alternate embodiments, the flexible seat portion 14 may include one continuous pocket around the entire perimeter of the seat portion 14.

An additional feature that may be included on the bottom side 34 of the seat portion 14 is at least one tie mechanism 36. The flexible seat portion is shown with on of the tie mechanisms 38 for each of the pockets 26. The tie mechanisms 36 may be used to secure each of the plurality of leg members 16, 18, 20 within the respective pockets 26 of the flexible seat portion 14. The tie mechanisms 36 may employ Velcro, buttons or may simply be tied with a knot by the user. The tie mechanisms 36 prevent the leg members 16, 18, 20 from being pulled from the pockets 26 when a person to lifts the stool 10 from the seat portion 14, which people are typically accustomed to doing.

Figure 6:
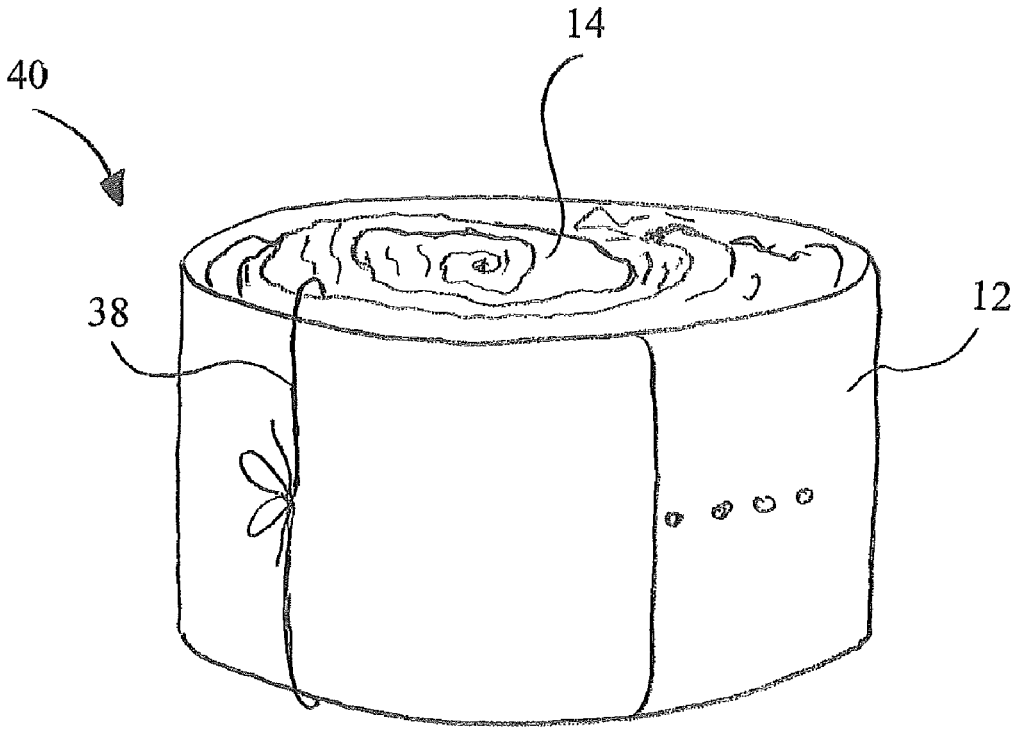
FIG. 6 depicts a perspective view of the flexible seat in FIG. 5 wrapped in the fulcrum band of FIGS. 2-4 for compact transportation in accordance with one embodiment of the present invention.
Figure 7:
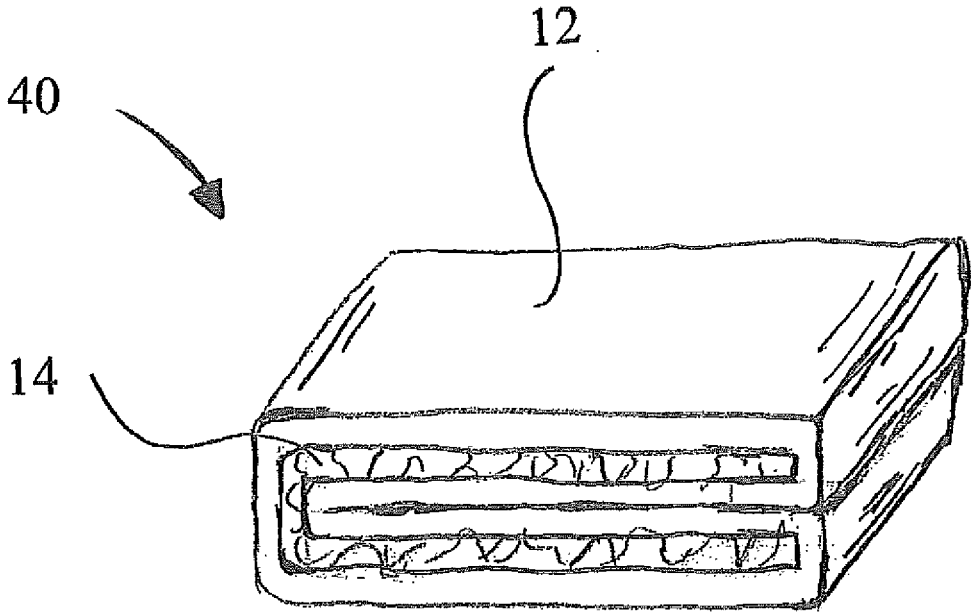
FIG. 7 depicts a perspective view of the fulcrum band and the flexible seat of FIG. 6, after the fulcrum band is flattened and folded in accordance with one embodiment of the present invention.

Turning to FIGS. 6 and 7, the apparatus for sitting 40 is shown in compact form for transportation and storage. The flexible seat portion 14 is shown wrapped within the fulcrum band 12. The tendency for the flexible seat portion 14 to expand radially after being wrapped up helps to retain the flexible seat portion 14 within the fulcrum band. Furthermore, the tie mechanism 38 of the flexible seat portion 14 is shown tied around the fulcrum band 12 for added support. Additionally, once the flexible seat portion 14 is stored within the fulcrum band 12 in this way, the fulcrum band 12 may be configured to collapse together and then folded into a wallet-shape, as shown in FIG. 7. Ultimately, a camper could thereafter carry the apparatus for sitting 40 within a pocket while hiking or camping.

Thus, a camper or hiker need only may pack this small, lightweight, and fully integrated apparatus for sitting 40 in order to assemble the stool 10 upon reaching a sitting destination in almost any camping or hiking environment. As long as any rod-like structures are available to act as the leg members 16, 18, 20, the compact apparatus for sitting 40 can be assembled into a sturdy and secure stool 10.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. An apparatus for sitting comprising:

a fulcrum band having an inner surface, the inner surface integrally including a plurality of pointed preparation members, wherein the fulcrum band is configured to hold together a plurality of leg members having different varieties, permitting the plurality of leg members to spread above and below the fulcrum band into a supporting position;

a flexible seat portion containing a plurality of pockets, each pocket configured to receive an upper end of one of the plurality of leg members when the plurality of leg members are in the supporting position; and wherein the plurality of pointed preparation members are configured to penetrate a wooden surface of at least one of the plurality of leg members when downward force is applied to the flexible seat portion.

2. The apparatus for sitting of claim 1, wherein the fulcrum band has an attachment mechanism for coupling longitudinal ends of the fulcrum band together.

3. The apparatus for sitting of claim 1, wherein a circumference of the fulcrum band is adjustable.

4. The apparatus for sitting of claim 2, wherein the attachment mechanism includes a plurality of longitudinally spaced holes extending from a first longitudinal end, and a pin located proximal to a second longitudinal end, the longitudinally spaced holes adapted to receive the pin.

5. The apparatus for sitting of claim 1, wherein the flexible seat portion includes a tie mechanism, the tie mechanism configured to retain at least one of the plurality of leg members within one of the plurality of pockets.

6. The apparatus for sitting of claim 1, wherein each of the plurality of pockets is configured to receive a leg member selected from the group consisting of tree branch, walking cane, ski pole, tent pole, metal rod, baseball bat, bamboo limb, hockey stick, golf club, and lacrosse stick.

7. The apparatus for sitting of claim 1, wherein the fulcrum band is configured to hold three or more leg members selected from the group consisting of tree branch, walking cane, ski pole, tent pole, metal rod, baseball bat, bamboo limb, hockey stick, golf club, and lacrosse stick.

8. The apparatus for sitting of claim 1, wherein the plurality of pointed preparation members are configured to penetrate leg members having a Janka hardness greater than 100 when the leg members are in the supporting position and downward force is applied to the flexible seat portion.

9. The apparatus for sitting of claim 1, wherein the fulcrum band is made of a material having a Young's modulus between 0.005 and 0.2 Gigapascals.

10. The apparatus for sitting of claim 1, wherein the fulcrum band is an unbroken ring.

11. The apparatus for sitting of claim 1, wherein at least one of the plurality of pockets includes reinforced fabric.

12. The apparatus for sitting of claim 1, wherein the flexible seat portion is storable within the fulcrum band, the fulcrum band being collapsible and foldable thereafter.

13. A method for sitting comprising:

providing a plurality of leg members;

inserting the plurality of leg members into a fulcrum band, the fulcrum band being adapted to receive leg members having a variety of shapes and sizes;

spreading the plurality of leg members above and below the fulcrum band into a supporting position;

inserting an upper end of each of the plurality of leg members into a pocket of a flexible seat portion, whereby the flexible seat portion adapted to support a person; and penetrating a surface of at least one of the plurality of leg members with a plurality of pointed preparation members integrally located on an inner surface of the fulcrum band when the person sits in the flexible seat portion.

14. The method of sitting of claim 13 further comprising adjusting a circumference of the fulcrum band.

15. The method of sitting of claim 13 further comprising coupling two longitudinal ends of the fulcrum band together with an attachment mechanism.

16. The method of sitting of claim 13 further comprising packing the flexible seat portion within the fulcrum band for compact transportation after use.

17. The method of sitting of claim 16 further comprising tying the flexible seat portion to the fulcrum band with a tie mechanism, wherein the tie mechanism is integrated on the flexible seat portion.

18. The method of sitting of claim 13, further comprising tying at least one of the plurality of leg members to the flexible seat portion with a tie mechanism.

19. An apparatus for sitting comprising:

a semi-flexible fulcrum band having an inner surface, the inner surface integrally including a plurality of pointed preparation members, wherein the fulcrum band is configured to hold together a plurality of leg members and permitting the plurality of leg members to spread above and below the fulcrum band into a supporting position;

a flexible seat portion containing a pocket configured to receive an upper end of a leg member when the plurality of leg members are in the supporting position, whereby the flexible seat portion is adapted for supporting a seated person; and wherein the fulcrum band and the flexible seat portion are configured to permit the use of tree branches of a variety of shapes and sizes as one of the leg members and wherein the plurality of pointed preparation members are configured to penetrate an outer surface of the tree branch when the person sits in the flexible seat portion.

* * * * *